US007870755B2

(12) United States Patent
Hsu et al.

(10) Patent No.: US 7,870,755 B2
(45) Date of Patent: Jan. 18, 2011

(54) ICE MAKER EQUIPPED WITH A CONVECTION FAN

(75) Inventors: Shih-Hsien Hsu, Hsin Tien (TW); Rick L Gunderson, Greenville, MI (US)

(73) Assignee: Zippy Technology Corp., Taipei Hsien (TW)

( * ) Notice: Subject to any disclaimer, the term of this patent is extended or adjusted under 35 U.S.C. 154(b) by 421 days.

(21) Appl. No.: 11/960,487

(22) Filed: Dec. 19, 2007

(65) Prior Publication Data

US 2008/0223069 A1 Sep. 18, 2008

(30) Foreign Application Priority Data

Mar. 16, 2007 (TW) ..... 96109019 A

(51) Int. Cl.
*F25C 1/12* (2006.01)

(52) U.S. Cl. ..... 62/353; 454/347

(58) Field of Classification Search ..... 62/353; 454/339, 347

See application file for complete search history.

(56) References Cited

U.S. PATENT DOCUMENTS 4,852,359 A * 8/1989 Manzotti ..... 62/68
5,182,916 A * 2/1993 Oike et al. ..... 62/135
5,568,947 A * 10/1996 Paquette ..... 285/46
6,351,955 B1 * 3/2002 Oltman et al. ..... 62/71
6,438,988 B1 * 8/2002 Paskey ..... 62/353
6,732,537 B1 * 5/2004 Anell et al. ..... 62/71
7,222,497 B2 * 5/2007 An et al. ..... 62/353
7,266,973 B2 * 9/2007 Anderson et al. ..... 62/351
7,487,645 B2 * 2/2009 Sasaki et al. ..... 62/135

FOREIGN PATENT DOCUMENTS

TW 330978 5/1998
TW 396264 7/2000
TW M-284863 U 1/2006

* cited by examiner

*Primary Examiner*—William E Tapolcai
(74) *Attorney, Agent, or Firm*—Muncy, Geissler, Olds & Lowe, PLLC

(57) ABSTRACT

An ice maker equipped with a convection fan includes a control box, an ice making tray, a water intake unit and an ice sweeping shaft. The control box holds at least one convection fan and has at least one air inlet and one air outlet to allow the convection fan to generate cooling air convection to accelerate cooling speed and improve ice making efficiency.

1 Claim, 5 Drawing Sheets

ICE MAKER EQUIPPED WITH A CONVECTION FAN

FIELD OF THE INVENTION

The present invention relates to an ice maker equipped with a convection fan that has at least one air fan system to speed up cooling airflow to accelerate ice making speed.

BACKGROUND OF THE INVENTION

Ice cubes are frequently being added to people's drinks or used for various cooling purposes A wide variety of ice makers have been developed and marketed. Many of them focus on faster ice making speed and automation to enable users to get the ice cubes whenever needed. R.O.C. patent publication No. 330978 entitled "Automatic ice making apparatus and freezer" includes a water supply trough, an ice making tray and a water supply pump. The water supply rough is located in a freezer at a desired position and built with an improved structure, and a control procedure is provided for the automatic ice making apparatus. Another R.O.C. patent publication No. 396264 entitled "Ice making control apparatus for thermoelectric modular refrigerators" has a main heat exchanger and an auxiliary heat exchanger. The main heat exchanger includes a first thermoelectric module and a second thermoelectric module. The main heat exchanger and a plurality of heat exchange portions in the auxiliary heat exchanger can perform heat transfer to produce ice. The auxiliary heat exchanger receives a constant voltage. The voltage supplying to the main heat exchanger is determined by detecting the temperature of the freezer and the temperature difference thereof. When the temperature difference increases the voltage supplied to the main heat exchanger also is boosted. Otherwise the voltage is lowered. In other words, it adjusts ice making speed by altering the voltage through detection of the temperature of the freezer. Yet another R.O.C. patent No. M284863 entitled "Ice maker structure" includes an ice making module, a compressor equipped with a heat exchanger and an ice collection barrel. The ice making module has an ice making trough. The compressor is connected to a refrigerant pipe. Through the compressor and the refrigerant pipe temperature can be lowered to freeze the water in the ice making trough to become ice cubes. All the aforesaid conventional techniques try to accelerate ice making speed through the compressor or heat exchangers to lower the temperature faster. Trying to further speed up the cooling effect encounters many problems such as lack of space or increasing electric power consumption.

SUMMARY OF THE INVENTION

In view of the aforesaid problems occurred to the prior ice making techniques, the primary object of the present invention is to provide an improved ice maker to better utilize limited space and electric power and provide a desired ice making environment with a low and even temperature to accelerate ice making speed. The ice maker of the invention not only can speed up cooling and does not occupy a lot of space and improves efficiency.

The present invention provides an ice maker equipped with a convection fan. It includes an ice making tray, a water intake unit, an ice sweeping shaft and a control box. The control box has at least one convection fan and at least one air inlet and at least one air outlet to allow the convection fan to generate convection of cooling air. The air outlet directs airflow to the ice making tray so that the cooling air blows areas of the ice making tray where temperature drops at a slower speed. Thereby overall temperature dropping speed can be accelerated to improve ice making efficiency.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
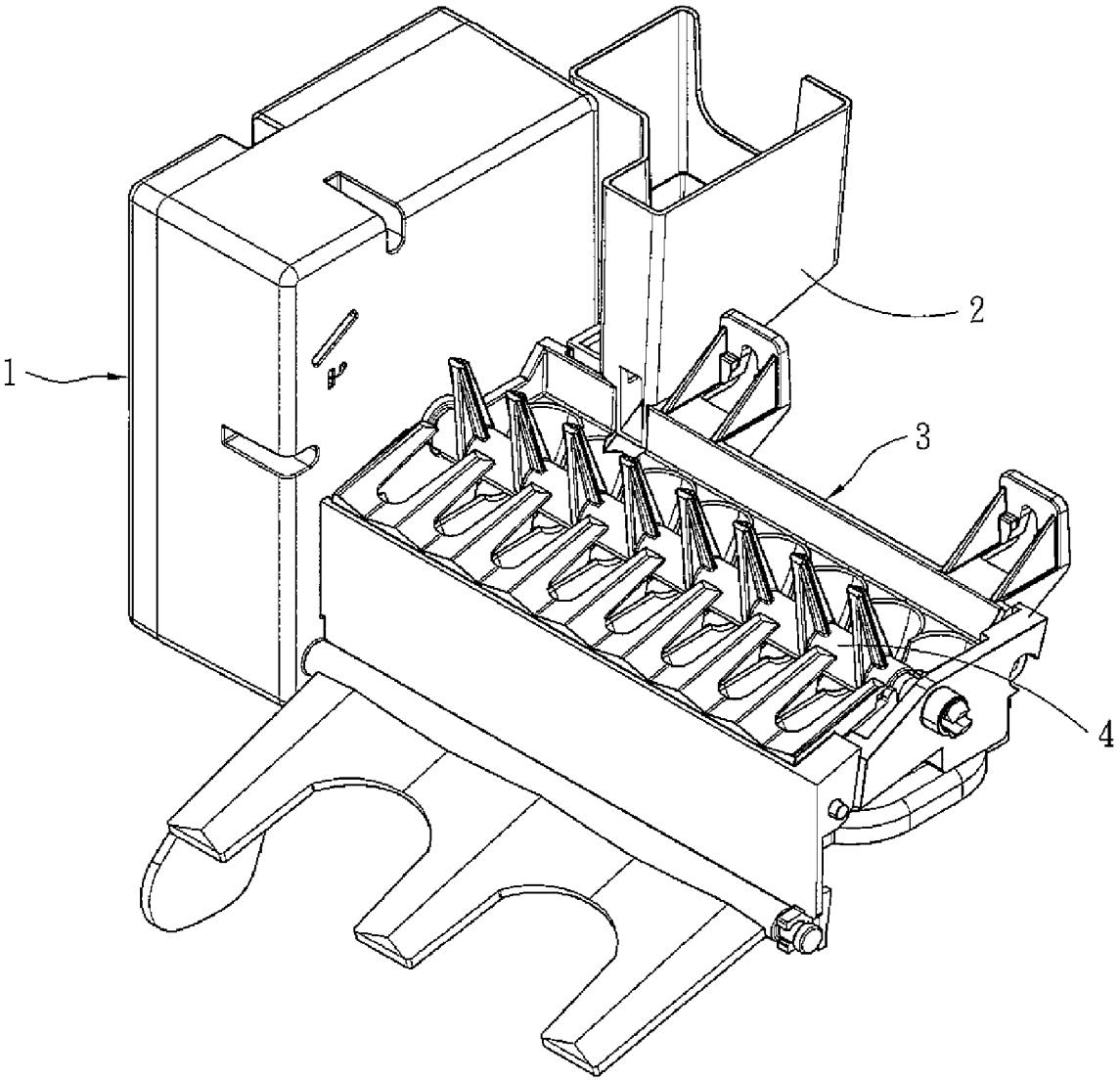
FIG. 1 is a perspective view of the ice maker of the invention.

Please refer to FIG. 1, the ice maker equipped with a convection fan according to the invention includes a convection fan 5. It is installed at a low temperature environment to automatically receive water and freeze the water to become ice cubes 8 (referring to FIG. 4B). Then the ice cubes 8 are automatically removed to resume the ice making process. It includes an ice making tray 3, a water intake unit 2, an ice sweeping shaft 4 and a control box 1. The water intake unit 2 directs clean water to the ice making tray 3. The water is frozen to become the ice cubes 8. Then the ice sweeping shaft 4 is rotated to remove the ice cubes 8 outside the ice making tray 3. The control box 1 controls operation procedures of the water intake unit 2 and ice sweeping shaft 4 to produce ice.

Figure 2:
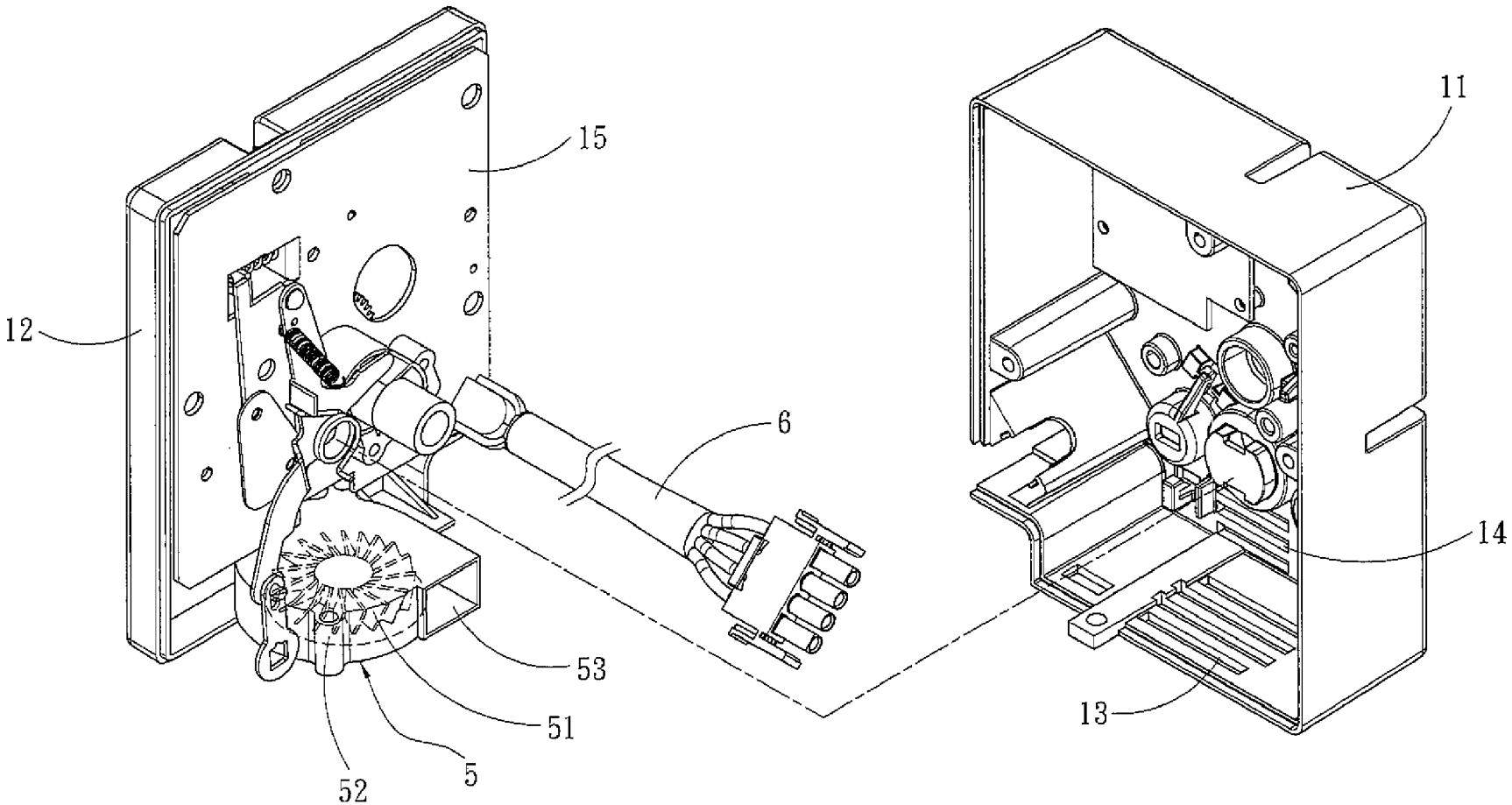
FIG. 2 is an exploded view of the control box of the ice maker of the invention.

Referring to FIG. 2, the control box 1 includes a front lid 11, a rear lid 12, a control unit 15, a power cord 6 and the convection fan 5. The front lid 11 and rear lid 12 are coupled together to encase the control unit 15 and the convection fan 5. The control unit 15 aims to control operation of the ice maker. The power cord 6 is connected to a power supply to provide driving power for the ice maker. The convection fan 5 includes a case encasing a blade assembly 51. The case has an air suction port 52 and an air discharge port 53. The front lid 11 has an air inlet 13 and an air outlet 14 corresponding respectively to the air suction port 52 and air discharge port 53. The air inlet 13 receives cooling air which is sucked by the convection fan 5 and discharged through the air outlet 14 to generate fast flowing cooling air to accelerate cooling speed. The convection fan 5, air inlet 13 and air outlet 14 may be located at a lower side of the control box 1 to direct the cooling airflow to the lower side of the ice making tray 3 where cooling is slower so that ice making speed can be accelerated.

Figure 3:
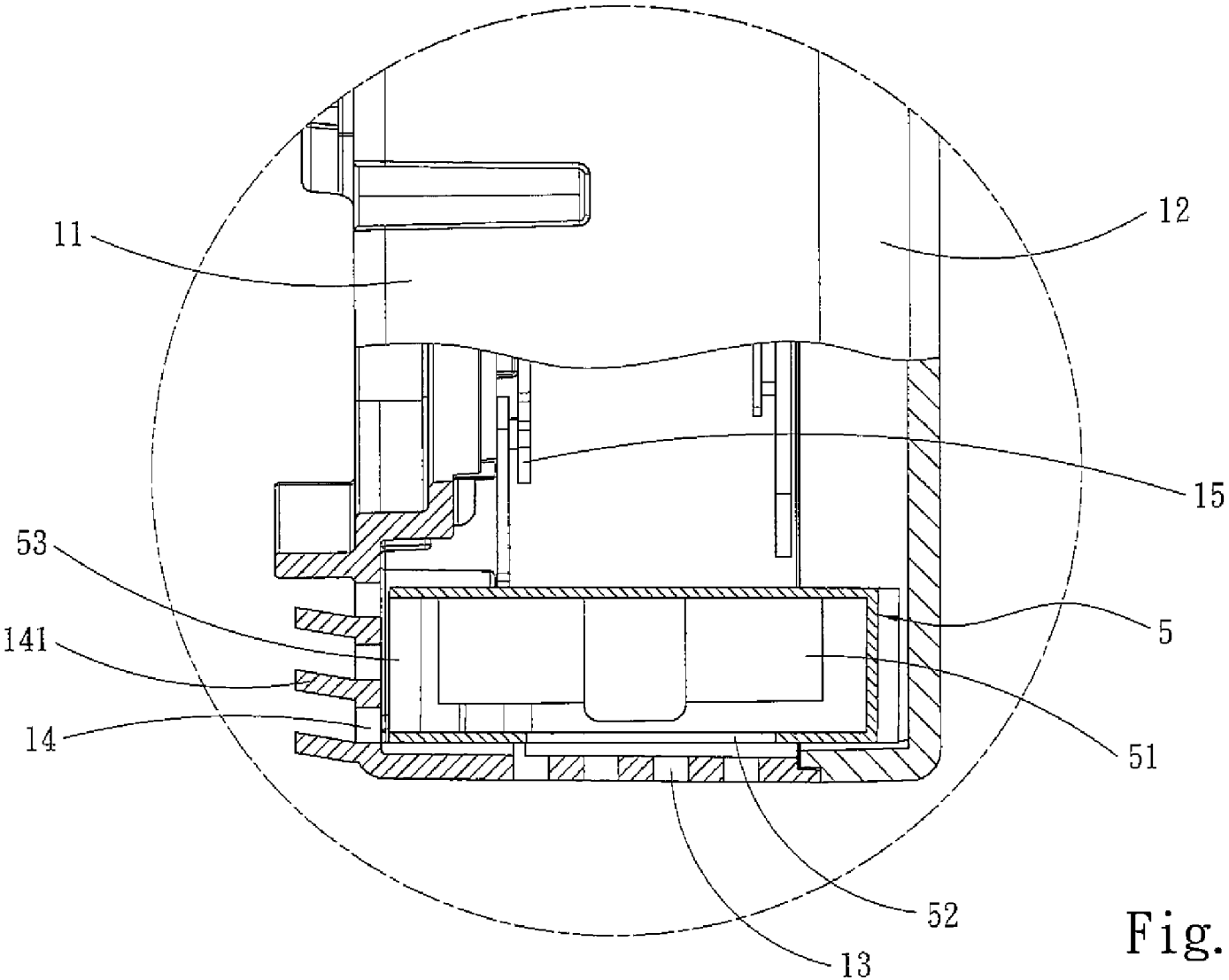
FIG. 3 is a fragmentary sectional view of the control box of the invention.

Referring to FIG. 3, the convection fan 5 is located at a lower side of the control box 1. The front lid 11 has a plurality of air outlets 14 at the bottom thereof to allow the convection fan 5 to receive the cooling air. There are a plurality of air directing plates 141 located outside the air outlets 14 that are disposed at an inclined angle to direct the cooling air towards the ice making tray 3 so that the cooling air can effectively lower the temperature of the ice making box 3.

Figure 4A:
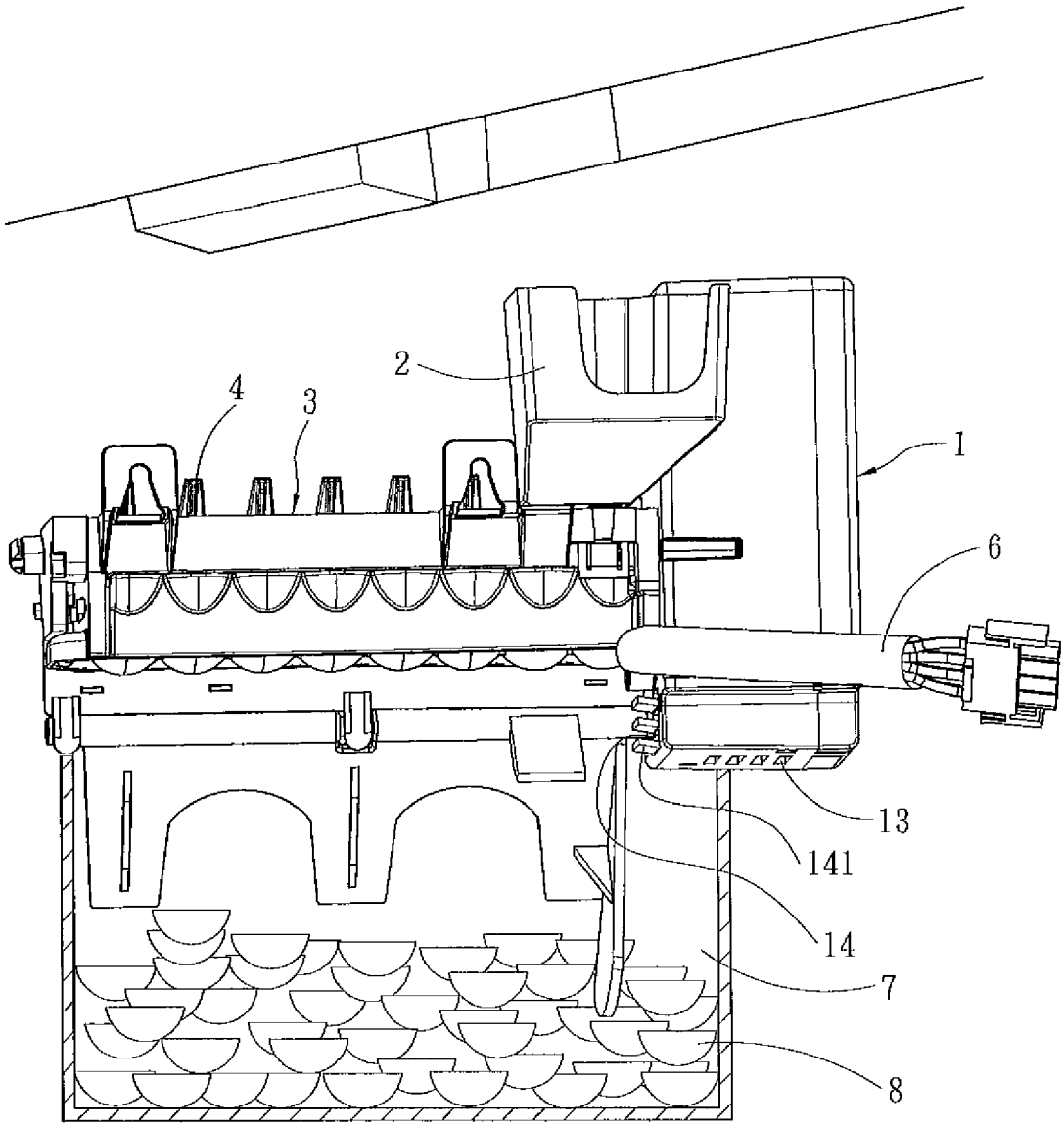
FIG. 4A is a schematic view of an embodiment of the invention.
Figure 4B:
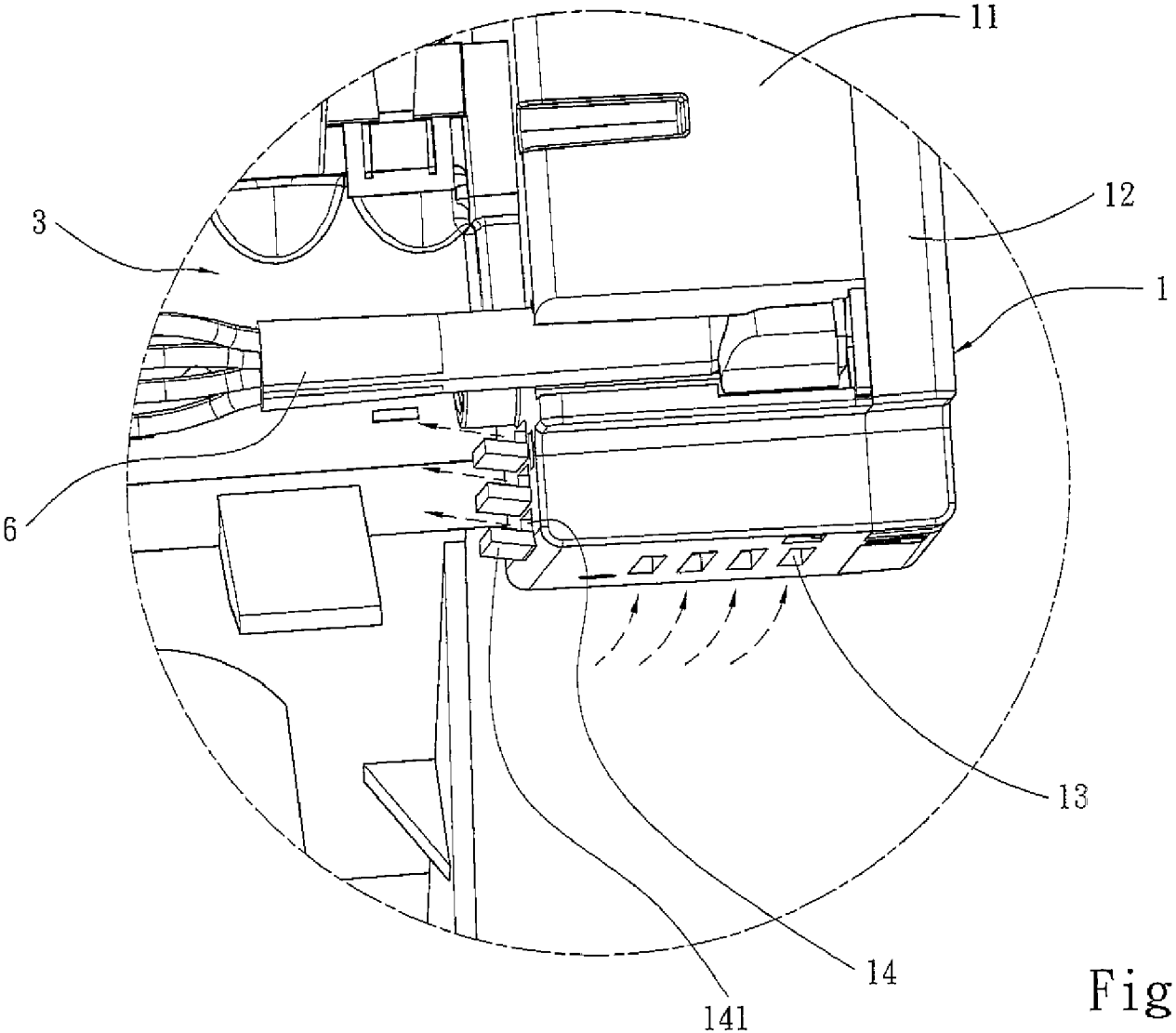
FIG. 4B is a fragmentary enlarged view of the embodiment of the invention.

Refer to FIGS. 4A and 4B for an embodiment of the invention. The invention may be located in a freezer to be coupled with an ice collection tray 7 to collect the ice cubes 8. The control box I has a plurality of air inlets 13 and air outlets 14 below the convection fan 5 at a lower side of the control box 1 (referring to FIG. 3). The convection fan 5 sucks cooling air through the air inlets 13 and discharges the cooling air through the air outlets 14. The directing plates 141 direct the cooling air to a lower side of the ice making tray 3 to lower the temperature faster so that water in the ice making tray 3 can be rapidly frozen in all directions.

While the preferred embodiment of the invention has been set forth for the purpose of disclosure and illustration, it is not the limitation of the invention. For instance, the convection fan 5, air inlets 13 and air outlets 14 are not necessary to be located at the lower side of the control box 1. The number of the convection fan 5, air inlets 13 and air outlets 14 also is not restricted. The number and inclined angle of the directing plates 141 can be altered to achieve a desired ice making efficiency. The air inlets 13 and air outlets 14 are not necessary to be confined at the front lid 11. Thus modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. An ice maker equipped with an air convection fan to automatically receive water and freeze the water to become ice cubes and automatically remove the ice cubes to resume ice making process, comprising:

an ice making tray to hold the water and provide a space to freeze the water to become the ice cubes;

a water intake unit to receive the water and direct the water to the ice making tray;

an ice sweeping shaft to remove the ice cubes formed in the ice making tray out of the ice making tray;

a control box which holds at least one horizontal convection fan located at a bottom of the control box and has an air inlet located at the bottom of the control box and an air outlet directed to the bottom of the ice making tray to allow the convection fan to generate cooling air convection to accelerate cooling speed of the ice making tray to improve ice making efficiency; and a plurality of directing plates located at the air outlet at an inclined angle to direct airflow to the bottom of the ice making tray.

* * * * *